United States Patent [19]

Hodgson et al.

[11] Patent Number: 4,841,654

[45] Date of Patent: Jun. 27, 1989

[54] HEADER FOR MERCHANDISE DISPLAY FIXTURE AND SIGN ASSEMBLY THEREFOR

[75] Inventors: Dale Hodgson, Parma; John Stram, Strongsville, both of Ohio

[73] Assignee: American Greetings Corporation, Cleveland, Ohio

[21] Appl. No.: 23,193

[22] Filed: Mar. 9, 1987

[51] Int. Cl.[4] ..... G09F 3/18

[52] U.S. Cl. ..... 40/642; 40/584; 40/607

[58] Field of Search ..... 40/584, 309, 10 R, 518, 40/471, 642, 309, 584, 518, 124, 607

[56] References Cited

U.S. PATENT DOCUMENTS

| | | | |
|---|---|---|---|
| D. 265,024 | 6/1982 | Johnson et al. . | |
| 1,526,007 | 2/1925 | Mills | 40/309 |
| 1,957,329 | 5/1934 | Erne | 40/309 |
| 2,327,742 | 8/1943 | Rosenberg . | |
| 2,984,031 | 5/1961 | Giesecke . | |
| 4,084,337 | 4/1978 | Tucker | 40/309 |
| 4,482,062 | 11/1984 | Huntsberry . | |

FOREIGN PATENT DOCUMENTS

| | | |
|---|---|---|
| 57678 | 12/1986 | Canada . |
| 1031946 | 11/1986 | United Kingdom . |

*Primary Examiner*—Gene Mancene
*Assistant Examiner*—Wenceslao J. Contreras
*Attorney, Agent, or Firm*—Baldwin, Egan & Fetzer

[57] ABSTRACT

A header for mounting on a upright column or columns of a merchandise display unit, with the header being of generally arcuate configuration, in plan, and having vertically spaced tracks thereon receiving and mounting a removable flexible strip sign or signs, such as for instance a sign having advertising or caption indicia thereon. The tracks are so constructed and arranged that the sign can be expeditiously assembled onto the header by threading the flexible sign through slots and into the tracks for mounting the sign on the header, and also providing for rapid removal or changing of the sign.

The header, in certain embodiments, comprises a plurality of generally circular, in plan, sections connected together at predetermined peripheral locations thereof, with each section being adapted for mounting on a respective column of the display unit. The header may be formed of molded plastic upper and lower half portions, which are disposed in stacked back-to-back relation, and attached together, as by gluing, along a generally horizontal juncture plane, to form the complete header.

18 Claims, 7 Drawing Sheets

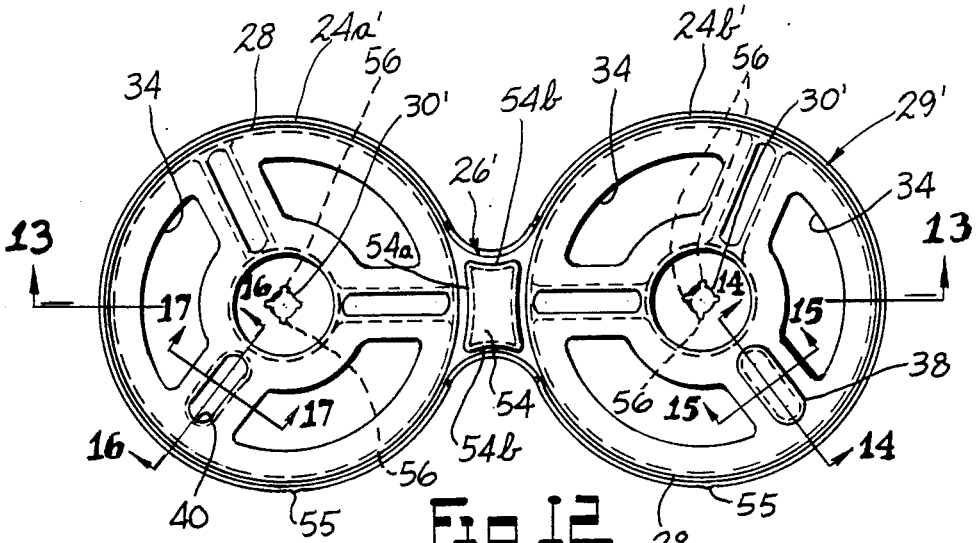
Fig 12
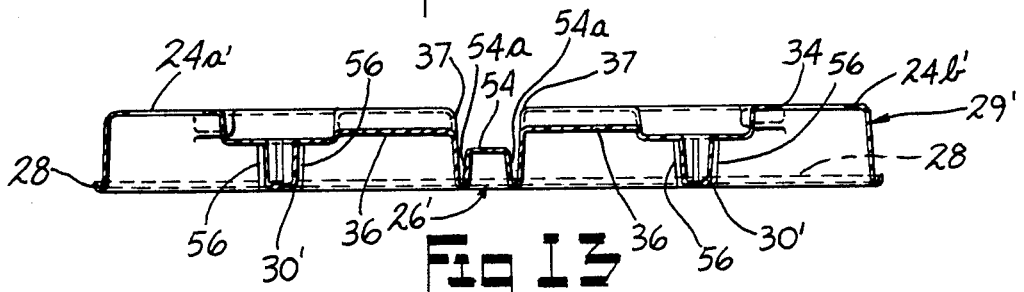
Fig 13
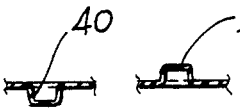
Fig 17
Fig 15
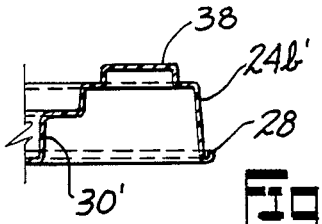
Fig 14
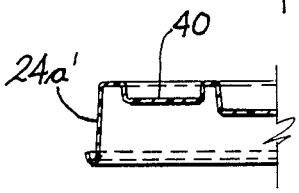
Fig 16

HEADER FOR MERCHANDISE DISPLAY FIXTURE AND SIGN ASSEMBLY THEREFOR

The present invention relates to a display fixture or unit for displaying merchandise, such as for instance, greeting cards, and more particularly relates to header structure for the top of such display unit, with the header being adapted to mount thereon a sign or signs such as an advertising or caption sign.

BACKGROUND OF THE INVENTION

Various types of article display units or fixtures, are well known in the prior art. For example, it is known in the art to provide what are called "spinner type" display units which consist of a column or columns mounting rotatable merchandise display shelves thereon, with such shelves having upwardly facing pockets for receiving and displaying merchandise therein, such as for instance, greeting cards. These display units, known in the art as aforementioned as "spinners" conventionally have a "header" mounted adjacent the upper end of the column or columns of the display unit, and such headers conventionally include thereon caption or advertising indicia.

However, the mounting of signs on such prior art headers has generally consisted of fastening a sign embodying caption indicia to the header, and the ability to rapidly mount a sign onto the header and to rapidly remove and/or change the sign on the header in the event of desire or necessity to change the sign, has not, to applicants' knowledge, heretofore generally been available to users of the display unit.

SUMMARY OF THE INVENTION

The present invention provides a header of arcuate configuration in plan, for a merchandise display fixture or unit, which header includes track structure thereon which enables the expeditious threading and self directing of a flexible strip sign into the track structure, for mounting the sign on the header, and for likewise changing the sign on the header, or removing the sign from the header, if it is desired to change the content of the advertising or the caption on the header sign. Also, the header is initially formed in half sections which are subsequently disposed in stacked back-to-back relation with one another and fastened together along a generally horizontal juncture plane, as by adhesive, or by heat or other suitable bonding procedures, to form the complete header for the merchandise display fixture.

Accordingly, it is an object of the present invention to provide a novel header for a merchandise display fixture or unit.

Another object of the invention is to provide a header which is comprised of half sections of generally the same or identical structure able to be disposed in stacked relationship with one another along a generally horizontal juncture plane, and enabling expeditious alignment and securement of the two stacked header sections to one another, to form the complete header, so that the latter can be utilized in a merchandise display unit.

A still further object of the invention is to provide a header arrangement of the afore-discussed type which includes thereon track structure which when the header half sections are secured or coupled together, provides vertically spaced tracks adapted to receive therein in self directing relation flexible strip sign means for mounting the sign means on the header, and wherein the sign means can be rapidly threaded into the tracks for mounting of the sign means, and just as rapidly changed, or completely removed from the tracks.

A still further object of the invention is to provide a header of the aforedescribed type which includes vertical openings extending therethrough, for permitting light to pass onto the underlying merchandise displayed in the fixture, and wherein the header also may provide for facilitating removal of merchandise from the uppermost merchandise receiving pockets of the merchandise holding shelves on the display fixture.

A still further object of the invention is to provide a novel merchandise display fixture which embodies an upright column thereon, and merchandise receiving shelf members spaced vertically along the column, with at least certain of the shelf members each including an upwardly opening pocket therein adapted for receiving and displaying merchandise therein, such as for instance, greeting cards, and wherein the display fixture includes a header mounted on the column above the shelf members, with the header having means thereon for expeditiously mounting a flexible strip sign by providing for threading the sign into the sign mounting means on the header, and just as expeditiously providing for movement of the sign relative to the header, or complete removal of the sign from the header, in order to change the sign format.

A still further object of the invention is to provide a header of the aforedescribed type which can be mass produced from plastic material, utilizing known vacuum molding processes, and wherein shipping of the header is facilitated.

Other objects and advantages of the invention will be apparent from the following description taken in conjunction with the accompanying drawings wherein:

BRIEF DESCRIPTION OF THE DRAWINGS

FIG. 12 is a top plan view of another embodiment of header structure utilizing only two circular header sections connected together at their peripheries, rather than the three connected sections shown in FIGS. 1–11;

FIG. 13 is a sectional view taken generally along the plane of line 13—13 of FIG. 12 looking in the direction of the arrows;

FIG. 14 is a fragmentary, sectional view taken generally along the plane of line 14—14 of FIG. 12 looking in the direction of the arrows;

FIG. 15 is a fragmentary, sectional view taken generally along the plane of line 15—15 of FIG. 12 looking in the direction of the arrows;

FIG. 16 is a fragmentary, sectional view taken generally along the plane of line 16—16 of FIG. 12 looking in the direction of the arrows;

FIG. 17 is a fragmentary, sectional view taken generally along the plane of line 17—17 of FIG. 12 looking in the direction of the arrows;

FIG. 27 is a broken front elevational view of a flexible strip sign having a plurality of different type, spaced, advertising or caption indicia thereon, for use with the headers of FIGS. 1–26.

DESCRIPTION OF PREFERRED EMBODIMENT AND ALTERNATE EMBODIMENTS

Figure 1:
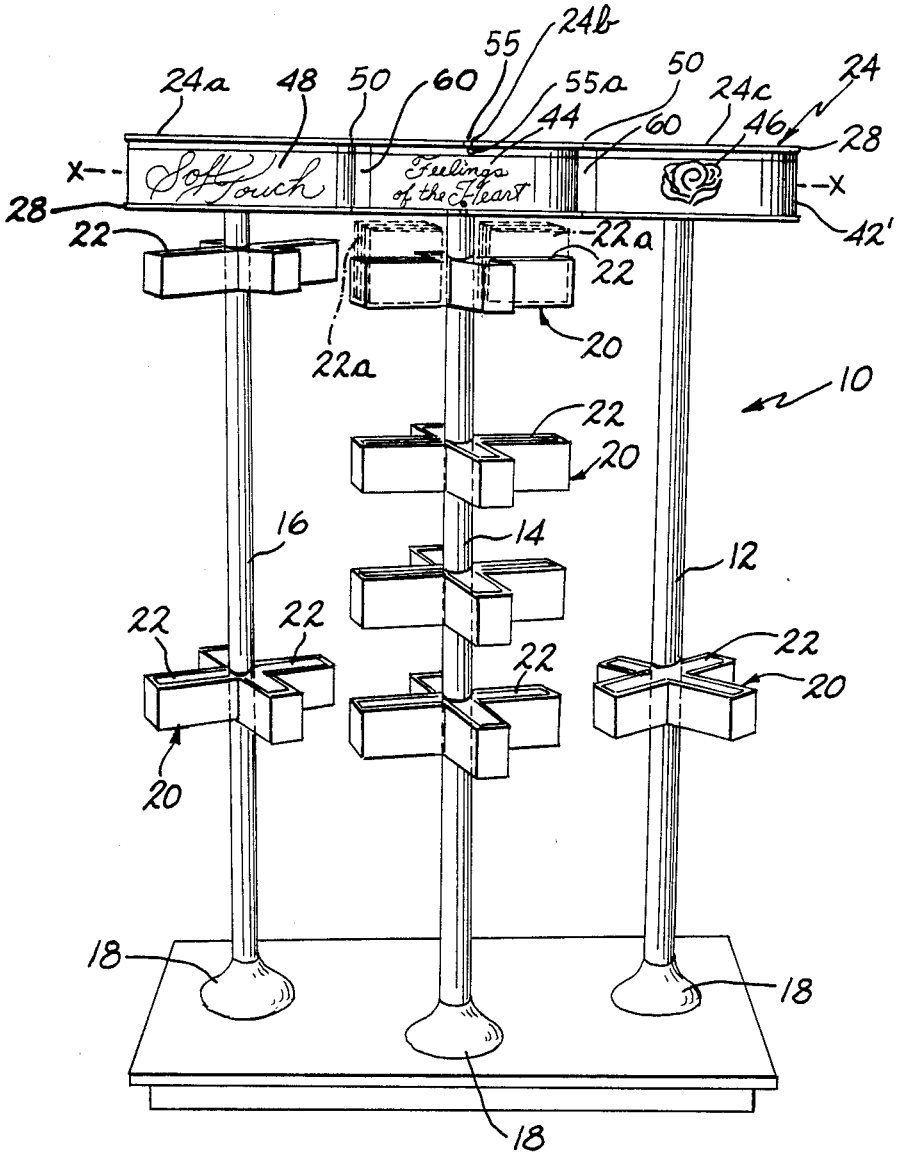
FIG. 1 is a generally diagrammatic, front perspective view of a "spinner type" display fixture including a header embodying the invention; a number of the conventional individually rotatable shelf members on the columns have been deleted in the FIG. 1 showing.
Figure 7:
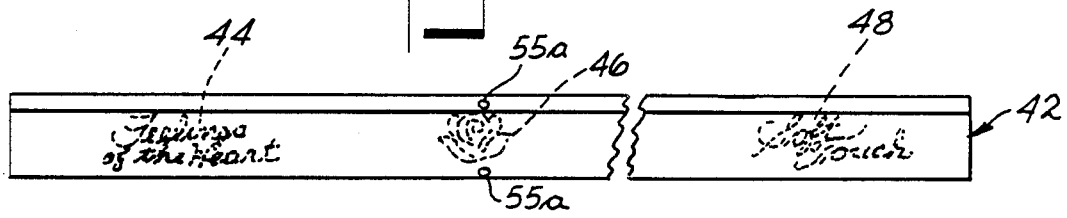
FIG. 7 is a fragmentary, sectional view taken generally along the plane of line 7—7 of FIG. 2 looking in the direction of the arrows.

Referring now again to the drawings, and particularly to FIG. 1 thereof, there is illustrated a merchandise display fixture or unit 10, which in the embodiment illustrated is of the "spinner" type and comprised of three columns 12, 14 and 16, each of which extends upwardly from a respective base portion 18, and which have a plurality of merchandise receiving members or shelves 20 disposed vertically along the respective column. Each shelf 20 in the embodiment illustrated, comprises upwardly opening pocket structure 22 which is adapted to receive therein merchandise for display, such as for instance greeting cards **22*a* shown in phantom in FIG. 1. Shelves 20** are preferably rotatable in generally horizontal planes with respect to the associated column for making readily accessible to the front of the merchandise display unit, the various pockets of merchandise on a respective shelf.

Conventionally, a merchandise display unit may have vertically spaced shelves extending from close to the base 18 thereof all the way up to adjacent the upper end of the display unit, and relatively close to the header structure 24 mounted on the top of the columns 12, 14 and 16, and as illustrated in FIG. 1. However, for ease and simplicity of illustration, only a few of the shelves conventionally mounted on the column or columns are illustrated in FIG. 1.

Header structure 24, with which the invention is particularly concerned, comprises, in the embodiment illustrated in FIG. 1, three, arcuate in plan (circular in the embodiment illustrated—FIGS. 2, 10 and 11) sections **24*a*, 24*b* and 24*c* which are connected together by connecting portions 26 at predetermined peripheral locations on the header sections, to form the total header. Each header section 24*a*, 24*b* or 24*c* is associated with a respective column 12, 14 or 16 of the display unit, and has peripheral track 28 extending thereabout, and communicating at the connecting portions 26, with the tracks 28** on the other header sections.

Figures 2, 3, 4, 5, 6, 7, 8, 9:
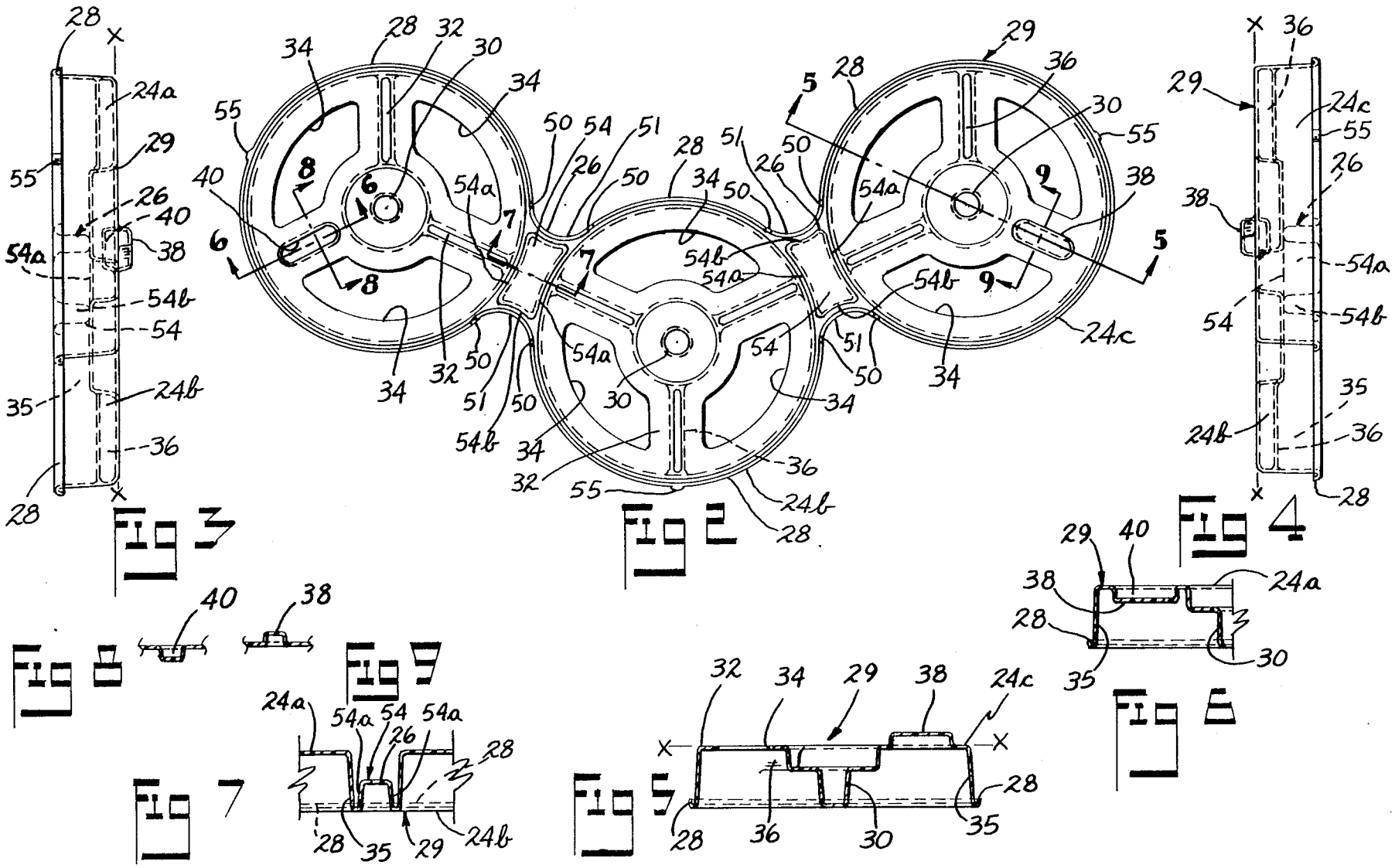
FIG. 2 is an enlarged top plan view of one of the half sections of the header structure illustrated in FIG. 1, which is adapted to be disposed in stacked relation with another like half section along a generally horizontal juncture plane and secured to one another, to form the complete header.
FIG. 3 is an end view of the header half section of FIG. 2 taken from the left hand end thereof.
FIG. 4 is an end view of the header half section of FIG. 2 taken from the right hand end thereof.
FIG. 5 is a sectional view taken generally along the plane of line 5—5 of FIG. 2 looking in the direction of the arrows.
FIG. 6 is a fragmentary, sectional view taken generally along the plane of line 6—6 of FIG. 2 looking in the direction of the arrows.
FIG. 8 is a fragmentary, sectional view taken generally along the plane of line 8—8 of FIG. 2 looking in the direction of the arrows.
FIG. 9 is a fragmentary, sectional view taken generally along the plane of line 9—9 of FIG. 2 looking in the direction of the arrows.
Figure 10:
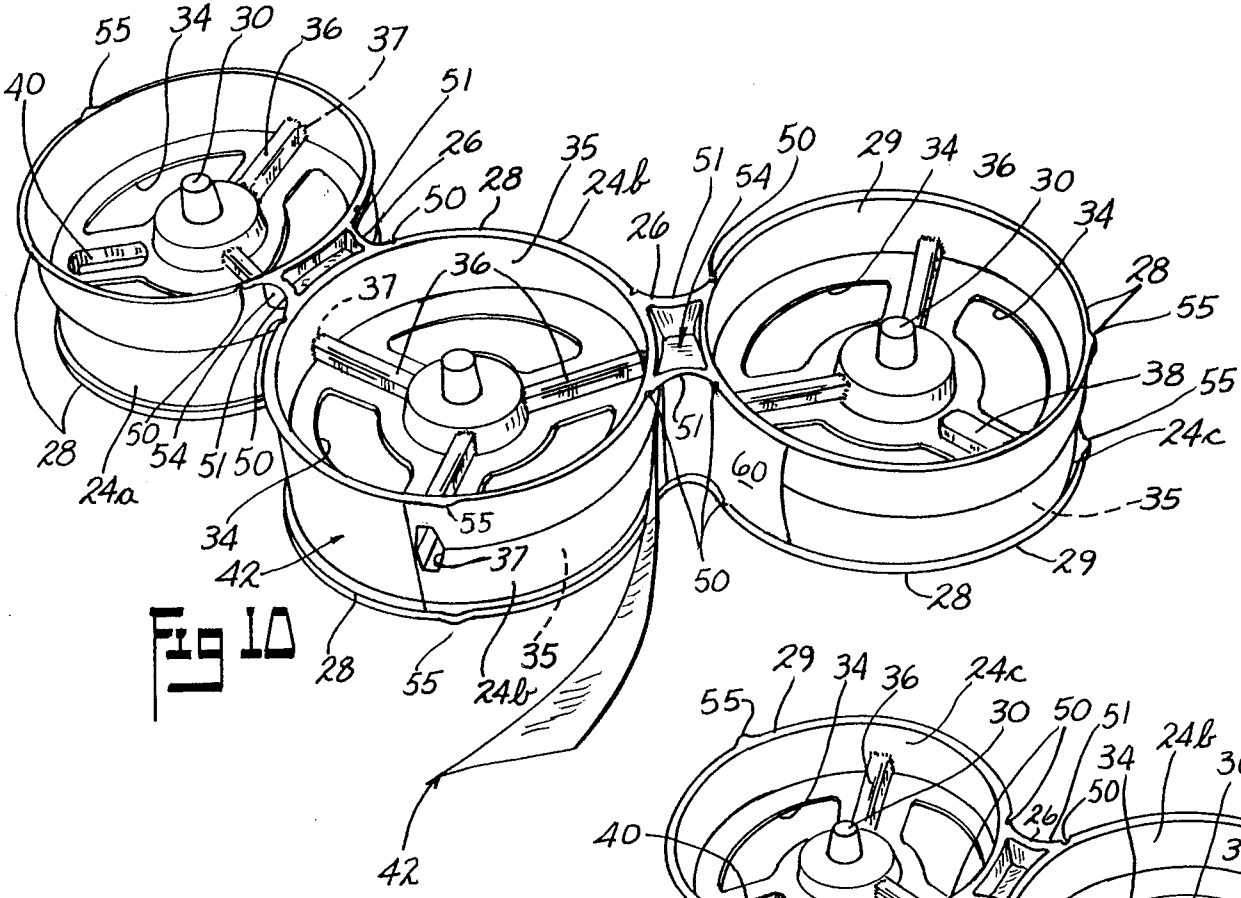
FIG. 10 is a perspective illustration showing the threading of a flexible strip sign into the vertically spaced tracks commencing with the central circular section of the header structure of FIGS. 1–9.
Figure 11:
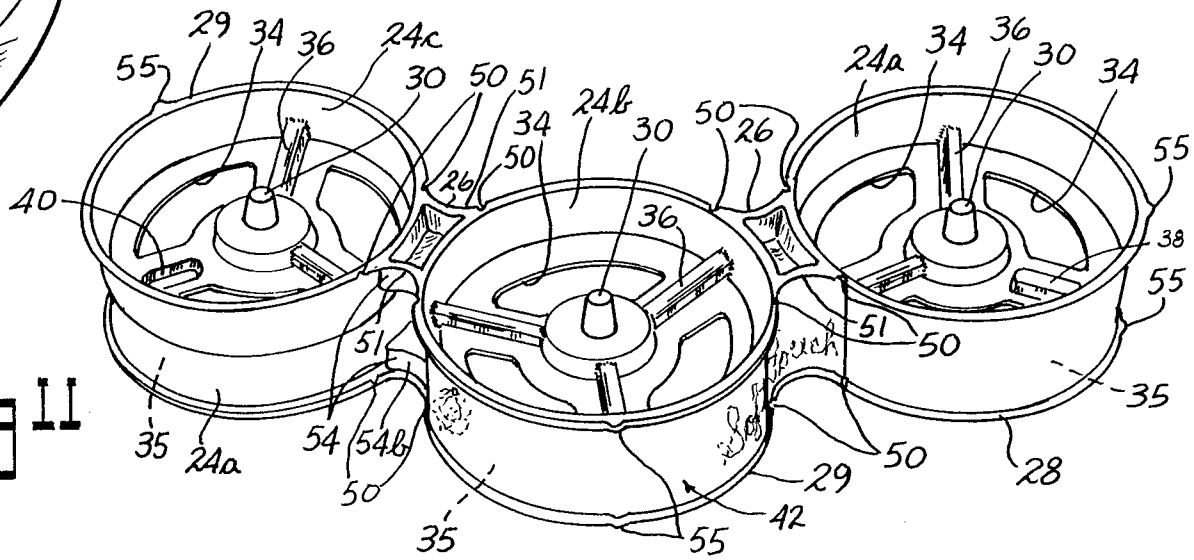
FIG. 11 is a view similar to FIG. 10 but showing self directing progress of one embodiment of sign about the periphery of the central section of the header structure with the sign being slidably movable via the tracks from the central section onto an adjacent header section (in this instance the right hand header section)
Figure 18:
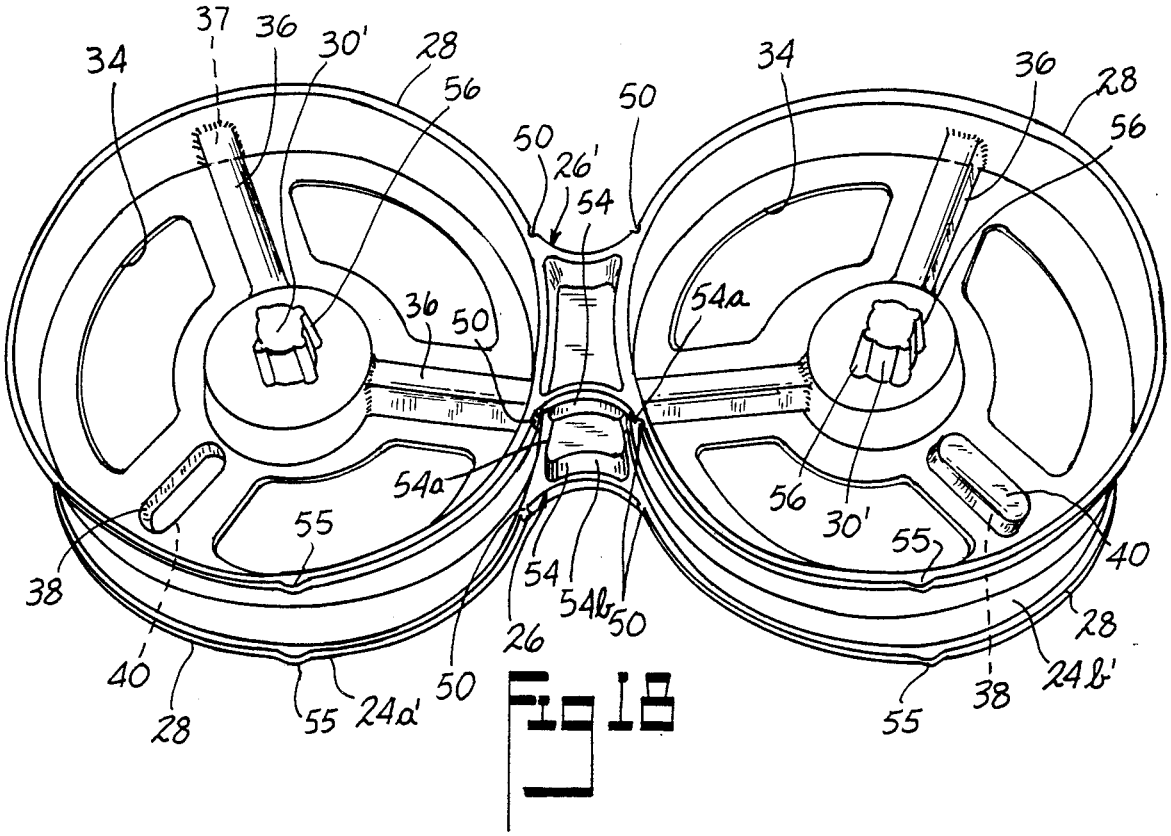
FIG. 18 is a perspective view of the header of FIGS. 12–17, from the top thereof.
Figure 19:
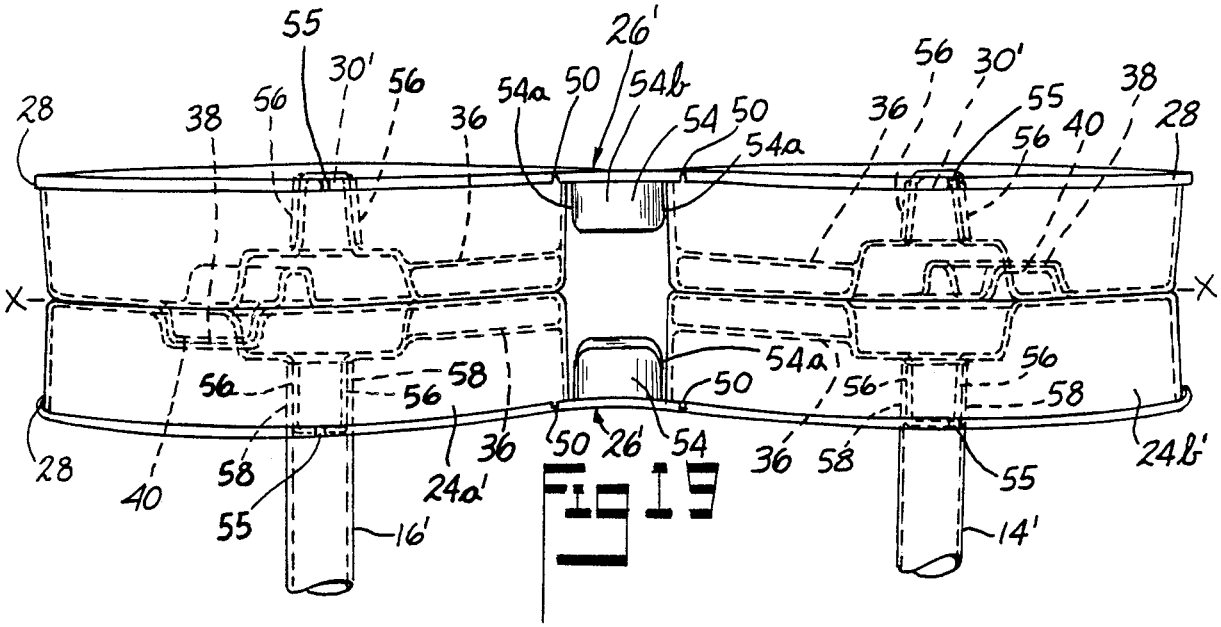
FIG. 19 is a generally front elevational view of the header of FIGS. 12–18, and as mounted on a pair of columns of a merchandise display unit, which may be of the aforementioned "spinner type" display unit.
Figure 20:
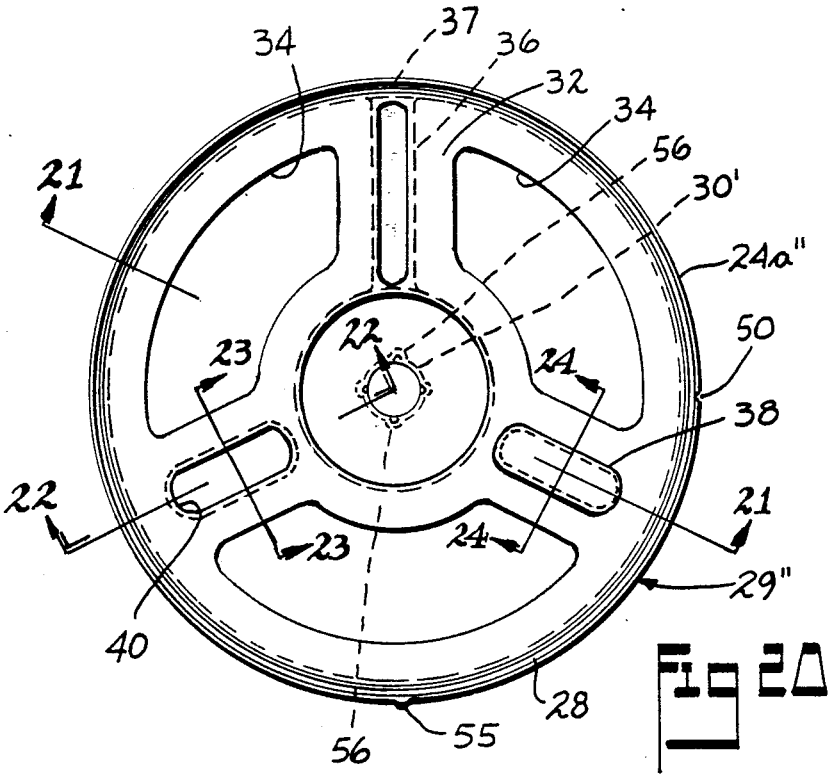
FIG. 20 is a top plan view of a further embodiment of header for a merchandise display unit, utilizing a single circular portion having arcuate track means thereon for threadingly receiving and mounting in self directing relation a flexible strip sign.
Figure 21:
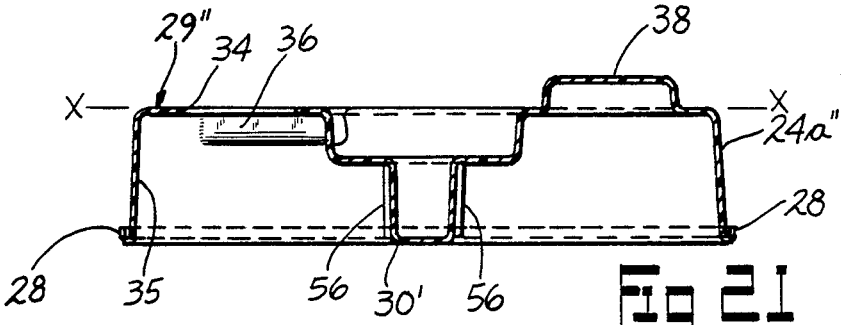
FIG. 21 is a sectional view taken generally along the plane of line 21—21 of FIG. 20 looking in the direction of the arrows.
Figure 23:
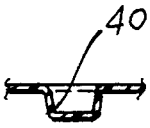
FIG. 23 is a fragmentary, sectional view taken generally along the plane of line 23—23 of FIG. 20 looking in the direction of the arrows.
Figure 24:
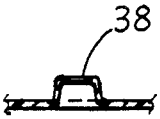
FIG. 24 is a fragmentary, sectional view taken generally along the plane of line 24—24 of FIG. 20 looking in the direction of the arrows.
Figure 22:
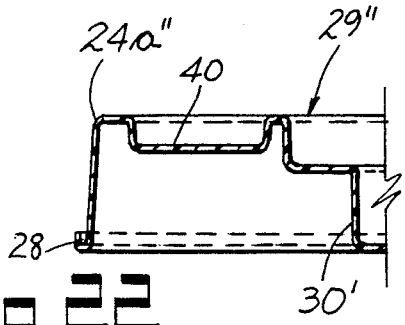
FIG. 22 is a fragmentary, sectional view taken generally along the plane of line 22—22 of FIG. 20 looking in the direction of the arrows.

Referring now particularly to FIG. 2, it will be understood that FIGS. 2–9 illustrate only one half section 29 of the total header structure, with the complete header structure being illustrated in FIGS. 1 and 10 and 11. Thus, to form the total or complete header structure illustrated in FIGS. 1 and 10 and 11, two of the header half sections 29 illustrated in FIGS. 2–9 are utilized in stacked, back-to-back relation with respect to one another along a general horizontal abutment plane X—X and then such upper and lower stacked half header sections are secured to one another by any suitable means, to form the complete header. FIGS. 10 and 11 as aforementioned illustrate the complete header comprised of two of the header half sections 29 of FIGS. 2–9 having been fastened to one another in stacked back-to-back relation along the aforementioned abutment or juncture plane X—X. Such fastening of the header half sections can be accomplished by any suitable means as for instance, adhesive means, or by heat bonding or heat welding, all of which are known in the art. The header half sections may be expeditiously formed and mass produced for instance, by vacuum molding of suitable known plastic or plastics and which has been found to be an expeditious method of producing the header.

As can be best seen in FIGS. 2–11, each circular header section 24*a*, 24*b* or 24*c* of each half section 29 comprises a formed central spindle 30 which is adapted to be received interiorly of the upper hollow end of the associated column in mounting the header on the columns in the merchandise display unit illustrated in FIG. 1. The base or back wall 32 of each of the arcuate header sections is provided with openings 34 therein which permits light to pass through the header structure onto the underlying merchandise in the pockets 22 of shelves 20, and the formed hollow recess 35 in the lower half section of the complete header facilitates the removal of the merchandise from the pockets 22 and more particularly the merchandise in those upper shelves of the merchandise display unit which are generally immediately adjacent the bottom of the header, and as will be hereinafter described in greater detail. Radially extending hollow ribs 36 may be provided on back wall 32 and in recess 35 of each header section, for strengthening purposes. Such ribs may open to the exterior surfaces of the respective header section, as at 37 (FIG. 10).

Each header half section 29 as illustrated in FIG. 2, preferably has a projection 38 formed on one of its outer arcuate sections (and in the embodiment illustrated in FIG. 2 is formed on the right hand section 24*c*) and also a complementary sized recess 40 formed in the other outer arcuate section (and in the embodiment illustrated in FIG. 2 on the left hand circular section 24*a*). When a pair of the header half sections 29 (one of which is shown in FIGS. 2–9) are assembled with one another in back-to-back stacked relationship, to form the complete header, the projection 38 on the lower half section 29 of the complete header will be received in the recess 40 on the upper half section 29, while the projection 38 on the upper half section will be received in the recess 40 in the lower half section, for aligning the stacked header half sections with respect to one another during the attachment thereof together. As aforementioned, this attachment may be conveniently accomplished by utilization of adhesive or by conventional heat bonding and/or heat riveting methods known in the art, for securing together molded plastic members. In any event, the header half sections 29 when so disposed in stacked and secured relation, form the complete header.

Figure 28:
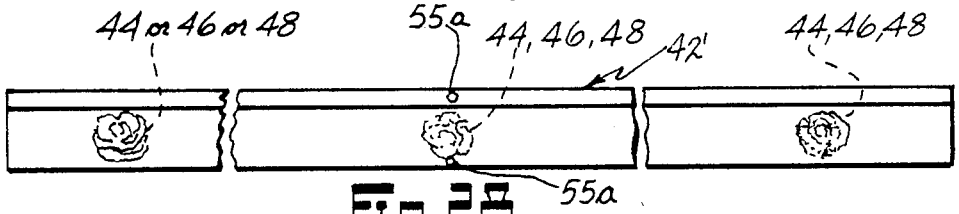
FIG. 28 is a broken elevational view of a strip sign illustrating another embodiment thereof, and wherein all of the spaced advertizing or caption indicia thereon are the same type or style.

The vertically spaced tracks 28 on the complete header define upwardly and downwardly facing channels for mounting a flexible strip sign e.g. 42 or 42' (FIGS. 1, 10, 27 and 28) on the header. Such sign may be formed of any suitable material, such as for instance flexible plastic or paper, and has imprinted or embodied thereon advertising or caption indicia, such as for instance the caption groups 44, 46 and 48 best illustrated in FIGS. 1, 27 and 28. The tracks or channels 28 are slotted as at 50 preferably adjacent the junctures of the connecting portions 26 with the circular header sections, so that the flexible sign 42 or 42' can be conveniently threaded into one header section and slidingly moved along the track structure 28, with one of the caption indicia on the respective sign being adapted to be positioned at a frontal showing location on the respective header section of the merchandise display unit, for advertising, for instance, the type or the origin of merchandise being displayed in the shelves 20 of the respective section of the display unit.

It will be understood that a sign e.g. 42' can be associated with each individual header section with such sign embodying thereon a plurality of spaced identical type advertising or caption indicia groups thereon (FIG. 28) so that the same indicia is located at spaced locations on the periphery of the header, or the sign may have a plurality of different type spaced advertising or caption indicia groups thereon (e.g. FIG. 27) so that the caption indicia that is positioned to appear on the front of the respective header section, can be changed by moving the sign slidingly along the tracks on the respective circular section. In other words, if the caption indicia 48 (FIG. 27) was initially fronting on the respective header section and it was desired to change such advertising or caption indicia to say for instance, the caption indicia 44, the sign may be manually slidingly moved in its track structure on its respective header section until such caption indicia 44 is positioned to appear at the front of the merchandise display unit on the respective header section. Also of course the entire sign could be changed by threading it out of the respective header section and replacing it with a new sign having a different caption indicia thereon.

It will be noted especially from FIGS. 10 and 11, that the track or channel structure 28 on the header extend about each individual arcuate header section and also are connected as at 51 at the connecting portions 26 of the header. Accordingly, it is possible to provide one long single strip sign, with a plurality of spaced advertising or caption indicia thereon and to thread the sign into a pair of the spaced slots 50 on the header and then move such single sign about all of the header sections until the desired advertising or caption indicia group appears at the front of the respective section of the header of the merchandise display unit. It will be understood therefore that it is not absolutely necessary to have three separate signs for header sections 24*a*, 24*b* or 24*c*, but that one sign with the adequate grouping of advertising or caption indicia thereon could be utilized for presenting three indicia groupings on the sign facing forwardly to the front of the merchandise display unit of FIG. 1, while providing for selectively changing such forwardly presented indicia by sliding the sign lengthwise of the retaining channels 28, until frontal presentation of other desired caption indicia on the sign is accomplished. However each header section may have its own individual sign of the type for instance shown in FIG. 28 wherein the spaced caption indicia are of the same type.

Each header section 24*a*, 24*b*, 24*c* preferably embodies sign locating projections or markings 55 thereon (FIGS. 2, 3, 10 and 11) which are adapted for alignment with markings or indicia 55*a* (FIGS. 27 and 28) on the signs to provide a mechanical means for proper positioning of the caption groups on the sign, so that such caption groups face forwardly of the respective header section, without the necessity for visual orientation by the installer.

It will be noted that the aforementioned connecting portions 26 on each half section 29 of the header comprise in the embodiment illustrated, an embossment 54 which has concave-like exterior defining side surfaces 54*a* and concave, defining end surfaces 54*b* with such side surfaces and end surfaces being in general alignment with the associated track means, for aiding in guiding the travel of the flexible sign as it moves on the tracks or channels about the periphery of the respective header section or between the header sections.

Referring now to FIGS. 12 through 19, there is shown another embodiment of the header in which only a pair of arcuate header sections 24*a*′ and 24*b*′ are provided connected at connecting portion 26′. This type of header is adapted for being used in a merchandise display unit which embodies only a pair of columns for mounting shelves 20 thereon rather than the triple column arrangement of the FIG. 1 display unit.

The formed spindle 30′ on each half section 29′ in this embodiment, may be provided with radially extending external ribs 56 (FIGS. 12 and 13) which are adapted to pass through complementary openings or slots 58 (FIG. 19) at the upper end of the respective column 14′ and 16′ (or in an adapter for each such column) to interlock the header with the respective column.

In other respects, this header structure is generally similar to that of the header of the first described embodiment of FIGS. 1–11 and like reference numbers have been utilized to refer to like structural components. This twin circular section header structure also embodies projection 38 thereon adapted to be received within a complementary recess 40 of the stacked back-to-back half sections 29′ to form the complete header when the header half sections are joined or fastened together along a generally horizontal juncture plane X—X as for instance, by means of adhesive or the like. Such joined half sections provide the vertically spaced tracks 28 for the complete header and in the same general manner aforedescribed in connection with the FIGS. 1–11 embodiment, such track structure preferably including the slots 50 therein for threading thereinto a flexible strip sign to present advertising or caption indicia facing forwardly on the merchandise display unit and for each header section of the header.

Referring now to FIGS. 20–24 there is shown a further embodiment of header wherein only a single arcuate header section is utilized rather than the paired grouping or the triple section grouping of the first described embodiments. FIGS. 20–24, of course, illustrate only a half header section 29″, with the complete header being formed by utilizing a pair of the half sections illustrated in FIGS. 20–24, disposed in stacked back-to-back relationship, and joined or connected together along a generally horizontal plane X—X to form the complete header.

This embodiment of header as illustrated also includes ribs 56 on the spindle 30′ thereof, similarly to the FIGS. 12–19 embodiment, and likewise includes a projecting portion 38 and a recess portion 40 formed thereon, adapted for coaction with the respective recess and projecting portion on the other header half section when assembled along the afore-mentioned generally horizontal juncture plane, for aligning the stacked upper and lower half sections 29″ with respect to one another prior to their being attached, to form the complete header.

Figure 25:
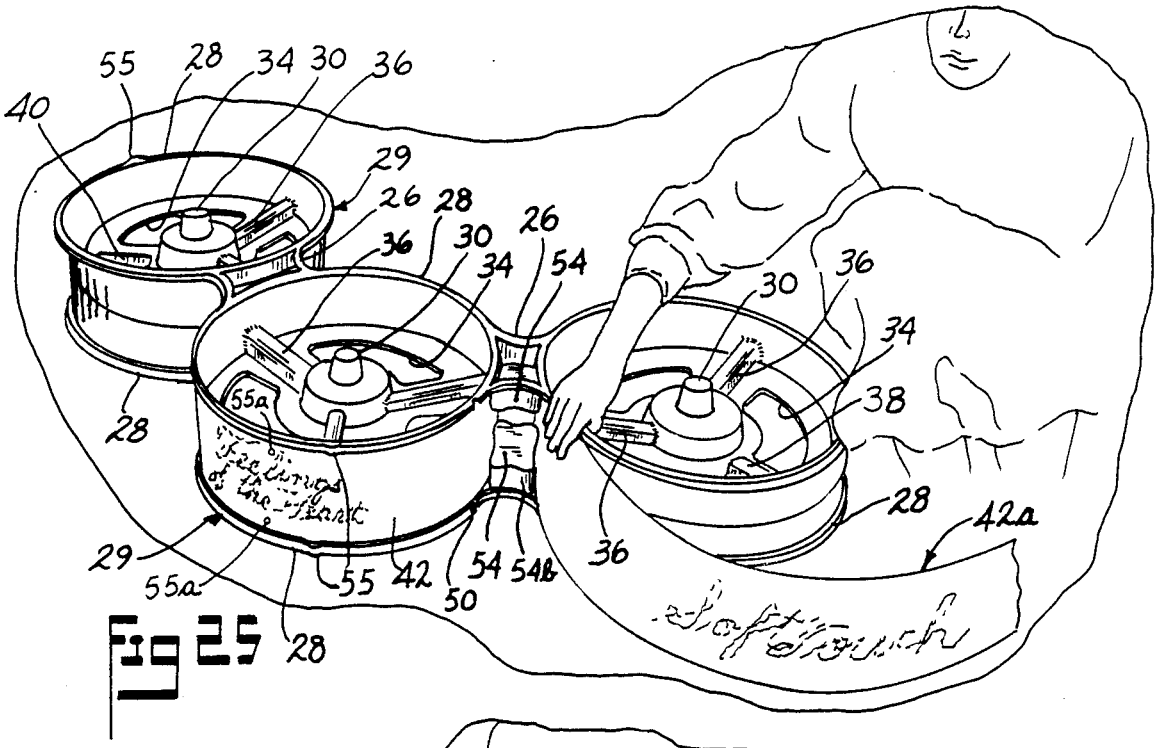
FIG. 25 is a diagrammatic perspective view of a three section header of the type of FIGS. 1–11, illustrating the threading of a flexible strip sign into the receiving tracks on the right hand header section, for mounting of the associated sign on that header section.
Figure 26:
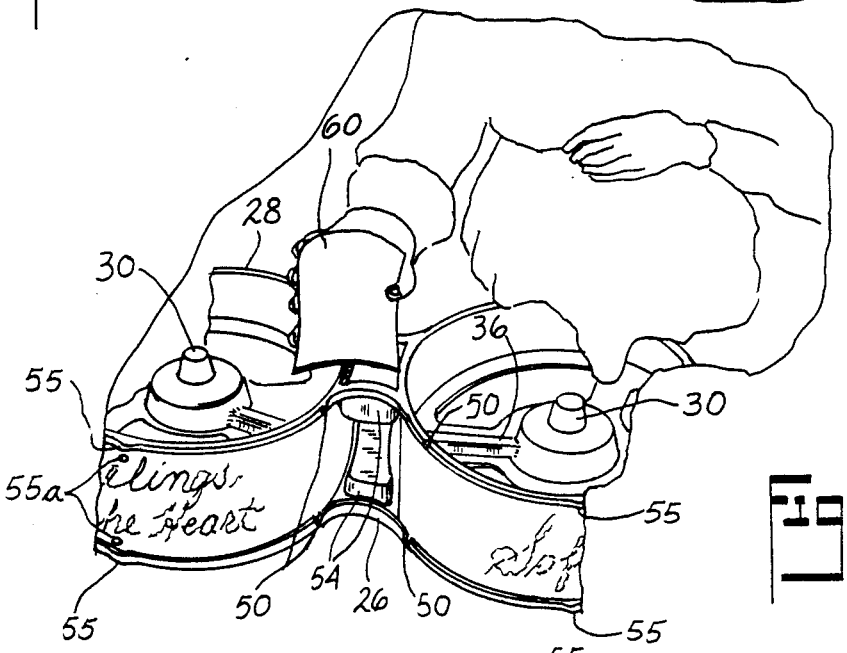
FIG. 26 is a fragmentary, perspective view illustrating the commencement of insertion of a fillet member into the tracks, at the connection between two adjacent header sections which have already had individual signs mounted thereon, for giving the general appearance of one continuous sign to the front of the header assembly in the manner illustrated in FIG. 1, with such fillet also hiding the connection structure between the header sections.

Referring now to FIGS. 25 and 26, there is illustrated in FIG. 25, the insertion of a flexible strip sign,(e.g. 42′), into the right hand header section of a three section group header (of the type for instance of FIGS. 1–11) subsequent to having already inserted a strip sign 42′ into the central header section, and showing one possible entry route into the tracks 28.

In order to give an improved appearance to the advertising or caption indicia and the associated sign structure on the header, as shown in FIG. 26, a flexible fillet member 60 may be inserted into the track structure at each of the connector portions 26 between each header section, so that at least from the front of the merchandise display unit, the sign mounted on each individual section of the header will appear to be smoothly continuous about the arcuate header configuration, with such fillet member 60 also concealing the connecting structure embossments 54. The continuous tracks 28 which extend about the respective header section and across the associated connecting portions 26 provide for mounting and retaining each applied fillet member 60 in position at the respective connecting portion 26.

Referring now again particularly to FIG. 1, it will be seen that when it is desired to remove merchandise from the pockets 22 in the shelves 20 lying immediately beneath the header structure of the display unit, the merchandise can be raised upwardly into the overlying recess 35 in the respective section of the lower half 29 of the header structure, in order to clear the associated shelf structure, and then the merchandise can be moved laterally and downwardly for complete removal from the display unit.

From the foregoing discussion and accompanying drawings it will be seen that the invention provides novel header arrangements for merchandise display fixtures or units, which header arrangements include track structure thereon enabling the expeditious threading in generally self directing relation, of a flexible strip sign into the track structure, for mounting the sign on the header, and for likewise changing the caption or advertising indicia of the sign on the respective header section, or removing the sign from the header if it is desired to completely change the content of the advertising or caption indicia on the header sign.

The sign may have a plurality of different type advertising indicia groups thereon, so that selected groups can be presented to the frontal side of the header by sliding the sign relative to the retaining track structure on the header, thus eliminating the necessity of completely removing a sign from the header if a change in the merchandise being displayed in the merchandise display unit is made, or the sign may have all the same type or style of indicia groups disposed in spaced relation thereon for use with a selected header section.

The invention also provides a header which is initially formed in half sections with such half sections being subsequently disposed in stacked back-to-back relation with respect to one another, and then fastened together along a generally horizontal juncture plane, as by means of adhesive or other suitable bonding procedures, to form the complete header for the merchandise display fixture.

The invention also provides a header of the aforementioned type which includes means thereon for aligning the header half sections with respect to one another in said horizontal plane prior to accomplishing attachment of the same together, thus facilitating the assembly of the half sections to form the complete header.

The header may also include vertical openings extending therethrough for permitting light to pass onto the underlying merchandise displayed in the fixture, and wherein underside recess areas in the molded header facilitates the removal of merchandise from the uppermost merchandise displaying shelves on the merchandise display unit, by providing clearance for the merchandise to be raised upwardly into the interior recess space of the header, and then by moving the merchandise laterally of the shelf members, it is moved out of interfering relationship with and past the respective shelf member.

The specific indicia on the header signs used with the multi-sectioned headers are physically separated yet retain a "family" look through the use of the arcuate shape of the grouped sections of the multi-sectioned headers.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

I claim:

1. A header for a merchandise display unit having means of arcuate configuration for mounting a sign thereon and operative to permit threading of a flexible strip sign into sign receiving and retaining relation on said means, and wherein said header comprises a plurality of arcuate, in plan, header sections connected together by portions at predetermined peripheral locations thereon to form total header, with each said header section including thereon said sign mounting means.

2. A header in accordance with claim 1 wherein said header is formed of separate upper and lower portions which are substantially identical to one another as formed and are then joined together along a generally horizontal juncture plane, to form the complete header.

3. A header in accordance with claim 1 wherein said connecting portions comprise an embossment having concave-like exterior defining side surfaces and disposed between each respective header section, said side surfaces being oriented in general alignment with the sign mounting means for guiding the travel of the flexible sign as it moves about the periphery of the respective header section.

4. A header in accordance with claim 1 including a flexible strip sign threaded into said sign mounting means in mounted relation on each said header section of said header, and fillet sign strips inserted into said sign mounting means at The juncture connections of said header sections with one another, so as to give the appearance of one continuous sign rather than a plurality of separate signs as associated with each respective header sections.

5. A header for a merchandise display unit having means of arcuate configuration for mounting a sign thereon and operative to permit threading of a flexible strip sign into sign receiving and retaining relation on said means, said header also comprising a body of generally arcuate configuration in plan with said arcuate means comprising spaced upper and lower tracks on said body following the general contour of said body, for receiving therein in relatively sliding relationship the sign, and operative to mount the latter on said body, and wherein said header comprises a plurality of arcuate, in plan, header sections defining said body, and connected together by portions at predetermined peripheral locations thereon to form the total header, and wherein each said upper and said lower tracks are continuous about each respective header section and also on the connecting portions thereof, whereby a sign can be threaded into one respective header section and moved onto another header section via said continuous tracks.

6. A header in accordance with claim 5 wherein said tracks comprise a pair of channels one of which faces upwardly and the other of which faces downwardly depending on whether said channel is on the lower or on the upper portion of said header with slot means in at least one of said channels for enabling the sign to be expeditiously threaded into the respective upper and lower pair of arcuate channels without substantial frictional resistance during assembly of the respective sign onto said header.

7. A header for a merchandise display unit having means of arcuate configuration for mounting a sign thereon and operative to permit threading of a flexible strip sign into sign receiving and retaining relation on said means, and which includes opening means therein extending generally vertically therethrough whereby light can pass without obstruction through said header onto an associated display unit.

8. A header in accordance with claim 7 which is comprised of molded plastic.

9. A header in accordance with claim 7 comprised of general circular sections, in plan, of molded plastic material connected together at certain locations along their peripheries to form a unitary header structure of grouped circular sections, with said arcuate configuration means comprising tracks continuous about each of said circular sections and said connecting certain locations whereby a sign threaded into said tracks adjacent one of said circular sections can be slidably moved and substantially self directed around all of the connected circular sections.

10. A header in accordance with claim 7 including means for mounting said header on a respective column of the merchandise display unit, and wherein the merchandise display unit includes merchandise receiving members having upwardly opening pocket structure therein adapted for receiving merchandise for display, said members being mounted on said column in vertically spaced relation, and wherein said header is disposed adjacent at least one of said members, with said header having recess means therein enabling merchandise to be removed from said pocket structure of said one member by moving it vertically upwardly partially into said recess means and then laterally and downwardly away from obstructing relation to said one member.

11. A header in accordance with claim 7 formed of separate upper and lower portions which are substantially identical to one another as formed and are then joined together along a generally horizontal juncture plane to form the complete header, and including projection and recess means on each said upper and lower portion thereof adapted for coaction with complementary means on the other said portion of the header, for aligning the header portions with respect to one another preparatory to said joining together thereof.

12. A header for a merchandise display unit having means of arcuate configuration for mounting a sign thereon and operative to permit threading of a flexible strip sign into sign receiving and retaining relation on said means, and wherein said header is formed of separate upper and lower portions fastened together along a generally horizontal juncture plane, and including projection and recess means on each of said portions adapted for coaction with one another for vertically aligning the upper and lower portions in said horizontal plane preparatory to fastening the same together.

13. A header for a merchandise display unit having means of arcuate configuration for mounting a sign thereon and operative to permit threading of a flexible strip sign into sign receiving and retaining relation on said means, said header being mounted on the upper end of a merchandise display fixture, said fixture comprising a generally vertical column with merchandise receiving structure projecting radially from said column and having therein upwardly opening pockets adapted for receiving merchandise for display, said header being mounted on the upper end of said column generally adjacent but above the uppermost of said merchandise receiving pocket structure, said header being of arcuate configuration in plan and including a flexible strip sign mounted on said sign mounting means.

14. A display fixture header in accordance with claim 13 wherein said sign mounting means thereon comprises spaced upper and lower tracks on said header receiving therein in relatively slidable and self directing relation said sign, said tracks being slotted at predetermined locations operative to permit said threading of said sign onto said mounting means on said header.

15. A merchandise display unit comprising a base, a column projecting generally vertically upwardly from said base, a plurality of merchandise receiving members disposed vertically along said column, each receiving member defining at least one upwardly opening pocket adapted to receive merchandise therein, such as for instance, greeting cards, and a header mounted on said column generally adjacent the uppermost merchandise receiving member and above the latter, said header having means of arcuate configuration in plan for mounting a sign thereon by threading a flexible strip sign into said sign receiving means on said header, whereby said sign can be conveniently assembled with, moved along, and removed from said header, said sign receiving means comprising upper and lower tracks on said header receiving therein in relative slidable relation said sign.

16. A display unit in accordance with claim 15 wherein said header includes a downwardly projecting spindle portion adapted for coaction with said column for supporting said header on said display unit, and said spindle portion having radially extending ribs thereon coacting with means on said column to interlock said header with respect to said column.

17. A header for a merchandise display unit having means of arcuate configuration for mounting a sign thereon and operative to permit threading of a flexible strip sign into sign receiving and retaining relation on said means, said header including a body of generally arcuate configuration in plan with said arcuate means comprising spaced upper and lower tracks on said body following the general contour of said body, for receiving therein in relatively sliding relationship the sign, and operative to mount the latter on said body, and including a flexible strip sign threaded into said sign mounting means in supported relation thereon, and means on said body adapted for alignment with means on said sign for aiding in positioning said sign for optimum visual effect relation to said body.

18. A header in accordance with claim 17 wherein said means on said body comprises protuberance means positioned respectively on said upper and lower tracks and projecting laterally thereof and positioned in predetermined relation with respect to the arcuate perimeter of said header, and said means on said sign comprising a mark thereon in predetermined relationship to the lengthwise extent of said sign and with respect to the advertising or caption indicia thereon, said sign being adapted to be slidingly moved in said tracks relative to said body until said mark on said sign is aligned with said protuberance means on said tracks.

* * * * *